United States Patent [19]

Campbell

[11] 4,181,467

[45] Jan. 1, 1980

[54] RADIALLY CURVED AXIAL CROSS-SECTIONS OF TIPS AND SIDES OF DIFFUSER VANES

[75] Inventor: Kenneth Campbell, Ridgewood, N.J.

[73] Assignee: Miriam N. Campbell, Oradell, N.J.

[21] Appl. No.: 8,151

[22] Filed: Jan. 31, 1979

[51] Int. Cl.[2] ..... F01D 1/02; F01D 9/00

[52] U.S. Cl. ..... 415/207; 415/211

[58] Field of Search ..... 415/207, 210, 211

[56] References Cited

U.S. PATENT DOCUMENTS

| | | | |
|---|---|---|---|
| 2,228,194 | 1/1941 | Birkigt | 415/211 |
| 2,708,883 | 5/1955 | Keller et al. | 415/207 |
| 3,778,186 | 12/1973 | Bandukwalla | 415/207 |
| 3,930,746 | 1/1976 | Kronogard | 415/207 |
| 3,964,837 | 6/1976 | Exley | 415/211 |
| 4,012,166 | 3/1977 | Kaesser et al. | 415/207 |
| 4,027,997 | 6/1977 | Bryans | 415/207 |

*Primary Examiner*—Louis J. Casaregola

[57] ABSTRACT

This invention is proposed to increase the efficiency of all vaned diffusers used in centrifugal compressors, without in itself further increasing the overall diameter. The invention is to curve in a radial plane, the axial cross-sections of vanes from tip to near the throat, so as logically to accommodate the heretofore deleterious effect of the long-recognized highly-arched relative velocity traverse across the impeller exit annulus, a recognition seldom reflected in diffuser structure over the past approximately 49 years of vaned diffuser development.

5 Claims, 4 Drawing Figures

VANE-SIDE CROSSECTIONS AT SECTIONS IN FIG. 3

RADIALLY CURVED AXIAL CROSS-SECTIONS OF TIPS AND SIDES OF DIFFUSER VANES

A valid criticism of my recently issued U.S. Patent referenced below, appears to apply to all conventionally-vaned diffusers regardless of their side-wall degrees of radial divergence, parallelism, or convergence, as well as applying to circular-crossection-type diffuser passages.

It has long been recognized by researchers and designers of centrifugal compressors that there can and usually does exist a highly-arched relative velocity traverse across the impeller exit annulus in an axial and radial plane. Nevertheless, it would appear that few designers (*) have ever so-modified their designs to reflect that recognition. (* D. P. Kenny of P & W of Canada, did indeed publish his vane tip-notch for exactly that purpose, but this inventor thinks that though it was most ingenious, it was not adequate.) (It was not similar in structure to the structure of the herein invention.)

The said velocity traverse out of the impeller causes the gas streamlines approaching the vane tips of the diffuser to vary widely across the tip and passage axially, in angle of attack, $\alpha_1$, and to a lesser degree, in Mach No, $M_1$. Thus unless the diffuser vanes are designed so that nowhere across them axially does any streamline enter at an angle of attack, and unless for a further distance of main gas travel the vane-sides are properly contoured both cross-wise and in the direction of gas travel to accommodate without deflection the many differently-angled side-by-side streamlines, the gas is undesirably suddenly deflected by most of the width of one side of the vane or the other or both, in effect a shock treatment, sub or supersonic, costly to the efficiency of the diffuser overall.

It is the purpose of this invention to meet that structural requirement.

As to priority of art, cited here are three filed U.S. Disclosure Documents assigned numbers 074922, 076884, and 077189, dated from Sept. 30 to Dec. 31, 1978. Combined, these 3 Documents disclose this invention nearly as fully as does this application.

The invention applies to both the so-called pure radial compressor, and to the so-called mixed flow compressor, the latter defined as having its impeller or diffuser or both having an axial component of main flow direction of their passages.

The fundamental considerations are herein first covered generally in the immediately following section: BACKGROUND AND FUNDAMENTALS. Then the section: DESCRIPTION OF THE INVENTION discusses the computed derivation results of a particular example, arriving at FIG. 4, which represents the invented feature of the proposed vane structure claimed, with of course discussion of FIG. 4 also.

BACKGROUND AND FUNDAMENTALS

Cited because relevant, is the inventor's issued U.S. Pat. No. 4,099,891, July 11, 1978, "Sawtoothed Diffuser, Vaned, for Centrifugal Compressors".

Said patent does meet its objective near the centerline only, of its vane-sides, and its claims are valid. But it used as example, flat crossection vane-sides, conventional in that respect only, and thus like all other diffusers it fails to meet its objective everywhere else than near the C/L axially across the vane-side. All previous diffusers have failed to meet that objective everywhere across them.

That objective is so to shape the side-walls and the vane-sides as to not deflect the on-coming gas stream by either side of a vane from its tip to near the throat; rather to let the gas follow vaneless paths everywhere in the passage until that structure be abandoned deliberately, in favor of more rapid diffusion with gas travel, the only purpose of multi-passage diffusers as distinct from vaneless diffusers. (In turn for minimizing overall diameter consistently with high efficiency.)

The invention herein is that in addition to the still-valid claims of referenced patent, the crossections axially of the early vane-sides to about the throat, should be curved in radial plane according to computed requirements, to meet that objective without the failure just defined above; that is, meet that structural requirement except in the edge boundary layer region, which seems to this inventor at least, to defy analysis. Perhaps better-qualified mathematicians can help design that edge-region of the vanes.

Further, these herein curved crossection vane-sides are found to reverse in curvature direction at a selected distance of gas flow from the tip, from convex inwardly beginning, to convex outwardly thereafter, until it be decided by the designer to abandon the principle of non-deflection of the gas stream by the vane-sides, per above.

Now, as stated previously, despite that this invention was inspired by need to correct the bad fault of the Sawtoothed Diffuser, it should be a big improvement to efficiency of all, yet-to-be-designed, multi-passage diffusers. True, though only the Sawtoothed Diffuser can meticulously achieve oblique isobars across all throats, by non-deflection of the stream from its true vaneless spiral streamlines entering, thus maintaining the highly oblique vaneless isobars, nevertheless, any diffuser using more conventional side-walls than the Sawtoothed Diffuser, whether parallel walls, diverging, or converging radially, should benefit in efficiency achieved, by these curved vane-side crossections prescribed herein.

Further, except for the difficulty per the next paragraph, using frequently used parallel effective walls, if one were willing to accept cost-wise, spiral vanes of near-zero constant thickness properly contoured, the objective that both sides of the vane shall not deflect the stream could nearly be met, without utilizing the patented Sawtoothed Diffuser structure.

The mentioned above difficulty on this, is that boundary layer grows on the vane sides as well as on the sidewalls, and if we have near-zero constant vane thickness, that thickness cannot be reduced further to let a vane-side boundary layer represent the effective vane-side instead. Now whether that particular shortcoming would negate all improvement from applying the same computed path to both sides of a near-zero-constant-thickness vane with curved crossections but conventional walls, this inventor does not know; it takes physical testing to find that out.

Both the referenced issued U.S. Pat. No. 4,099,891, and by implication the herein proposed one, have received a criticism of the former from several sources, namely, that all this is based upon solely inviscid steady-state flow relationships, without making proper "allowance" and modification, to try to overcome the deleterious effects on performance, of viscosity, such as the mysterious secondary flow phenomena and blockage which accompany viscous boundary layer formation.

In rebuttal to this, (given also in the referenced patent), those evaluations come mainly from physical testing, and adjustment by redesign, and more testing, of initially inviscid steady state designs. Well, no-one has ever started his physical testing with a correct inviscid flow design! And the finding of deleterious effects of viscosity on performance have been discouraging indeed, (like throat blockage). And so far, adjustments to inviscid flow design have not resulted in earthshaking improvement.

It is possible that starting with a correct inviscid flow design in the first place, instead of a wrong one, those deleterious effects of viscosity may well be found to be less than heretofore found by experiment. E.g., must we have always a normal or nearly normal isobar across the throat? No matter how designed? The inventor agrees, it takes expensive testing by an organization with resources and enthusiasm, to establish the Truth, or indeed falsity, of the above.

On the design herein, next section, both the referenced U.S. Pat. No. 4,099,891, and the current invention start with the message reflected by the credited, used, and detailed in the referenced patent, mathematics of E. S. Taylor, that for inviscid steady-state flow, the streamlines in a vaneless diffuser are seldom if ever log-spirals. (Correctly converged side-walls radially can create a log-spiral path, but what for?) Rather, the angles $\alpha$, between tangents to spirals, and tangents to great circles they intersect, are ever-declining with gas travel, including the case of parallel walls; and the greater the degree of wall divergence radially, the greater the rate of decline of $\alpha$ with gas travel, i.e., the faster the deviation inwardly from a log-spiral, of the gas path spiral.

In the interest of demonstrating that this invention may be applicable to conventional side-wall diffusers, I have herein selected parallel side-walls as the example to describe the invention.

(Not governing that choice of walls, parallel walls are far less time-consuming to compute for, because then one of the 2 independent variables, namely, vane-side-width ratio, $h_1/h$, becomes constant at 1.0, leaving only the choice of Mach No M, as the one independent variable, thus requiring only one straight-forward computation program per station on a spiral, about 120 mini-mini-steps charged by the computer. But diverging walls were computed for in referenced patent computations, as well as in the first of the three Disclosure Documents cited above.)

Further to the forthcoming example in the next section, this invention applies to transonic entry into the diffuser as well as subsonic. Therefore the example used herein is for a max entering $M_1$ of 1.2. (But at the end of this specification, those results are briefly compared with those of the expanded study using also a max entering $M_1$ of 0.9.)

FIG. 1, left, shows the assumed-as-example volocity traverse out of impeller exit annulus in radial and axial plane.

FIG. 1, right, combine this traverse volocity out at the C/L and at 4/5 of the way from C/L to side-wall, with same tip speed for both, to yield resultant absolute volocity, Mach No., and angle, of the gas approaching the diffuser vane tip for those 2 axial location only.

FIG. 4 is the basis of my claims.

DESCRIPTION OF THE INVENTION

Figure 1:
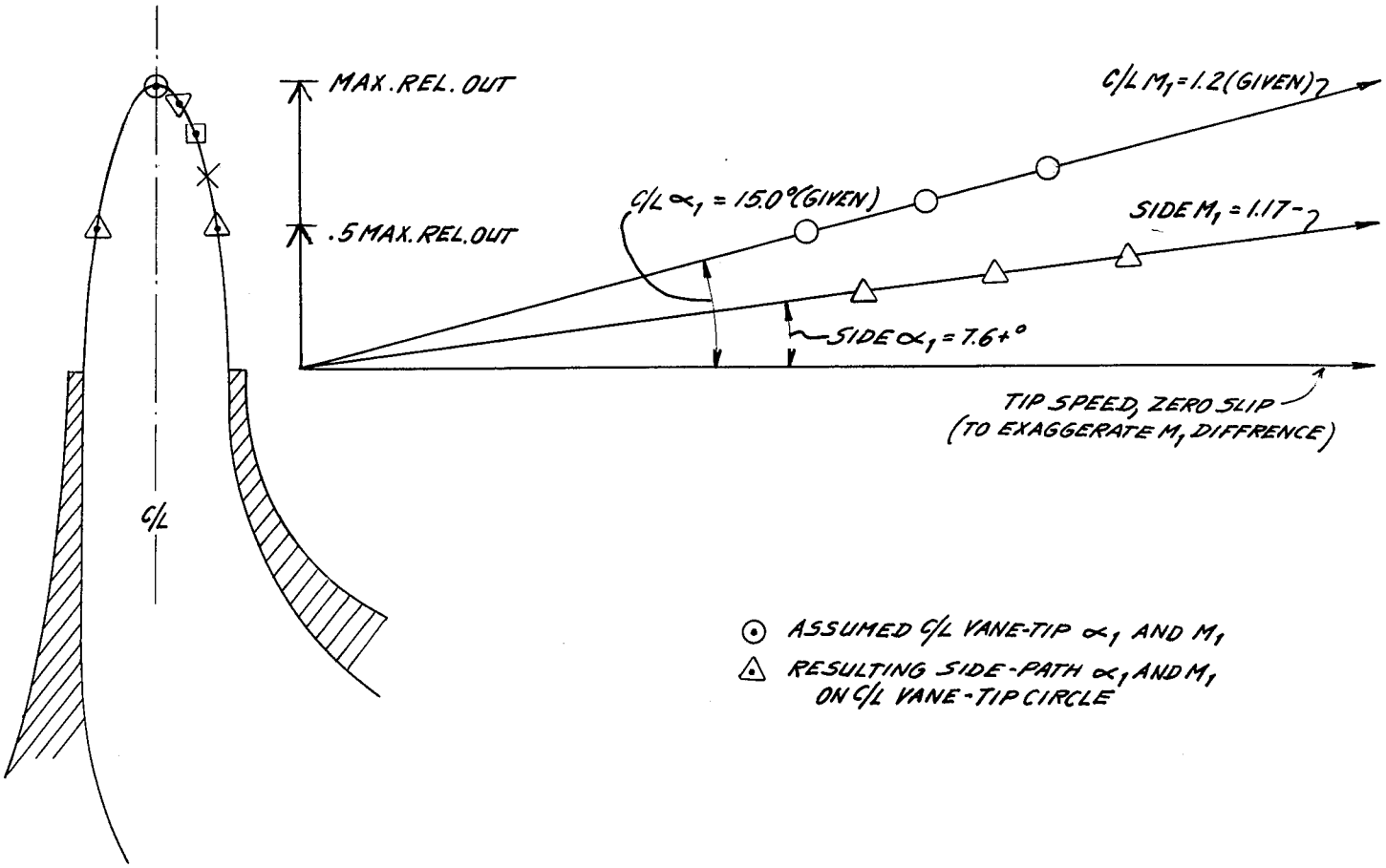
Figure 2:
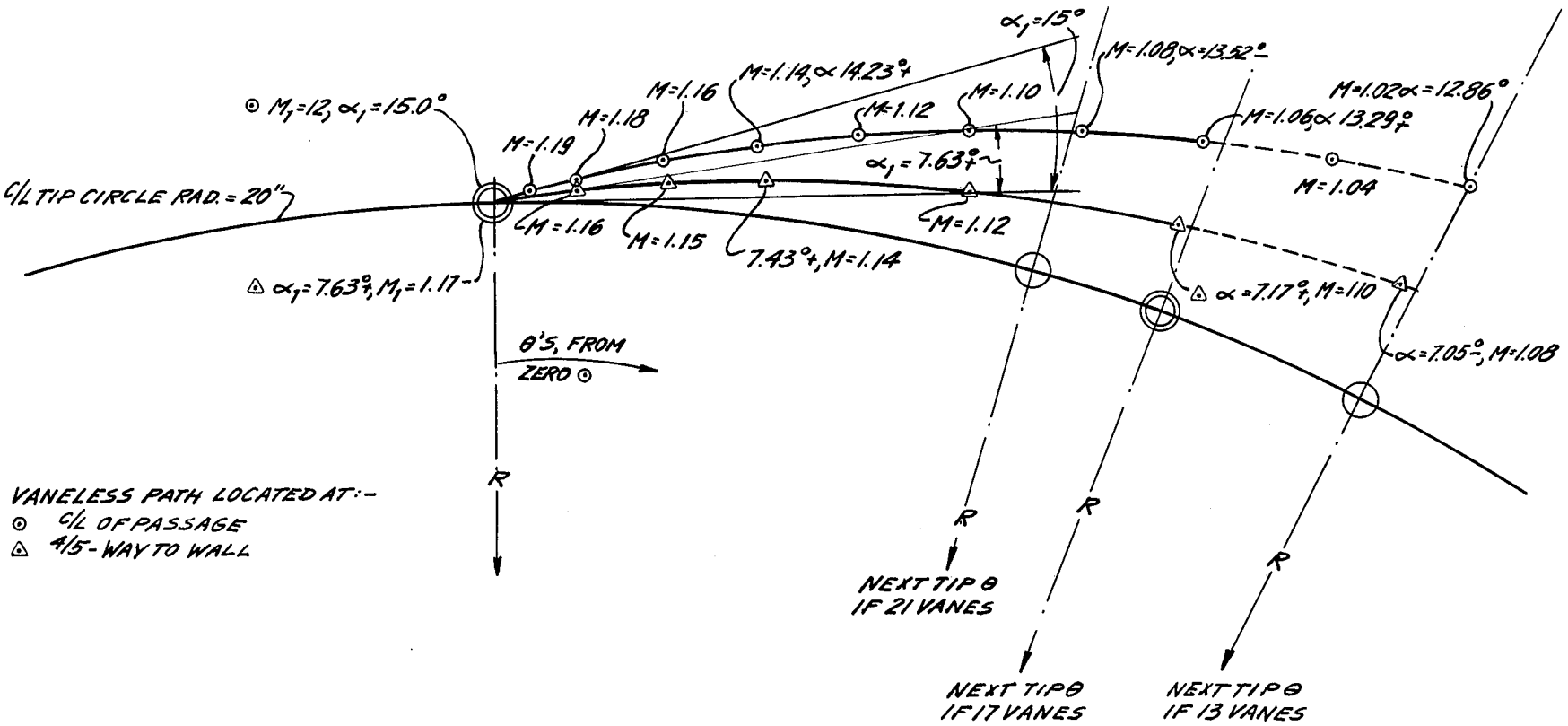
FIG. 2 shows for an example taken of parallel effective walls only, the computed per already issued patent theory, spiral gas paths in a vaneless diffuser, inviscid steady-state flow, resulting from the 2 approach volocities etc. of FIG. 1, right. Axial view.
Figure 3:
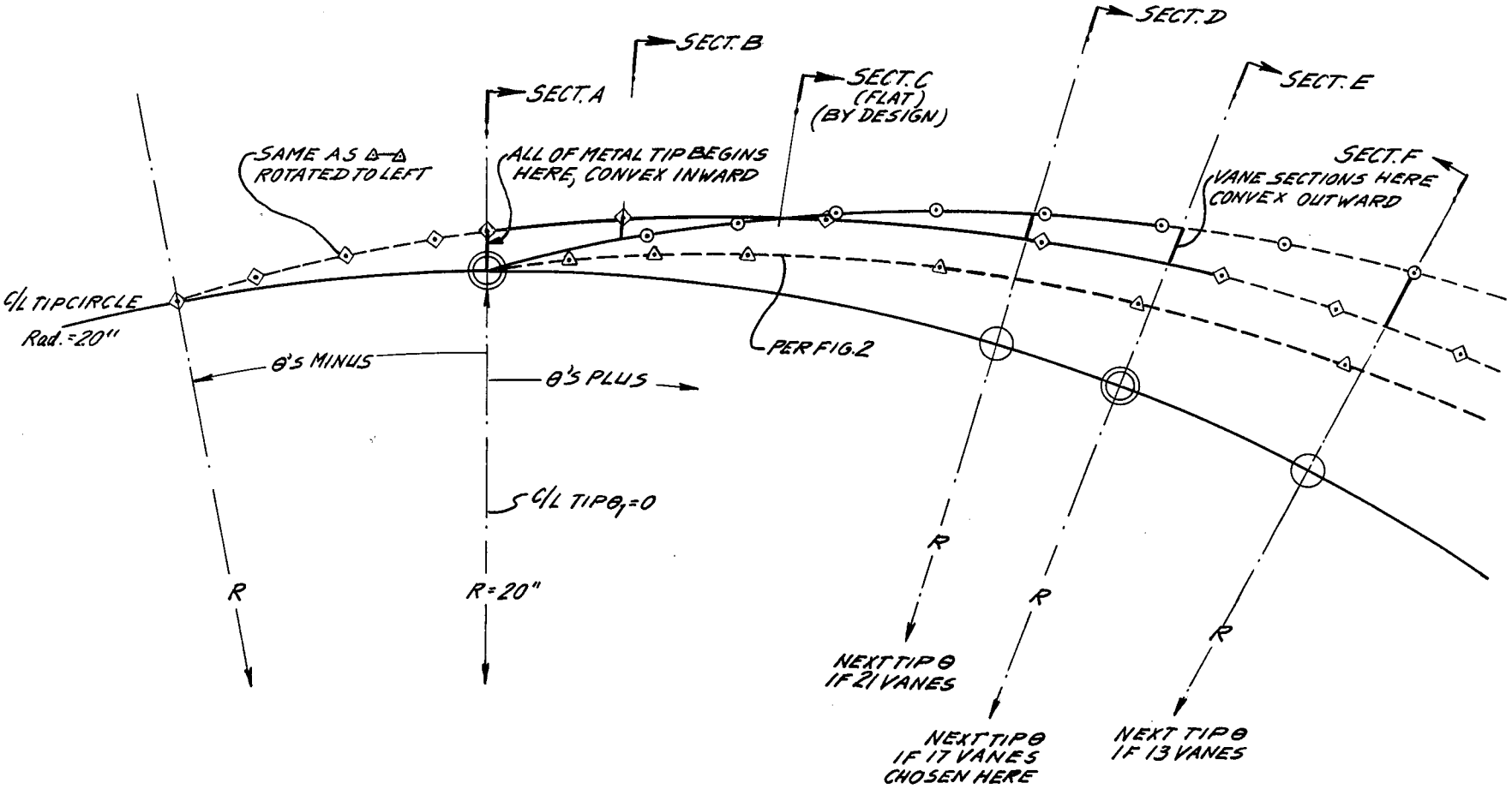
FIG. 3 shows for the same above C/L and "4/5-side" spiral paths of FIG. 2, the proper van-side spirals, station by station, in axial view, to accommodate properly the approaching and continuing gas stream in a vaneless diffuser, for the example taken, of parallel effective sidewalls only.
Figure 4:
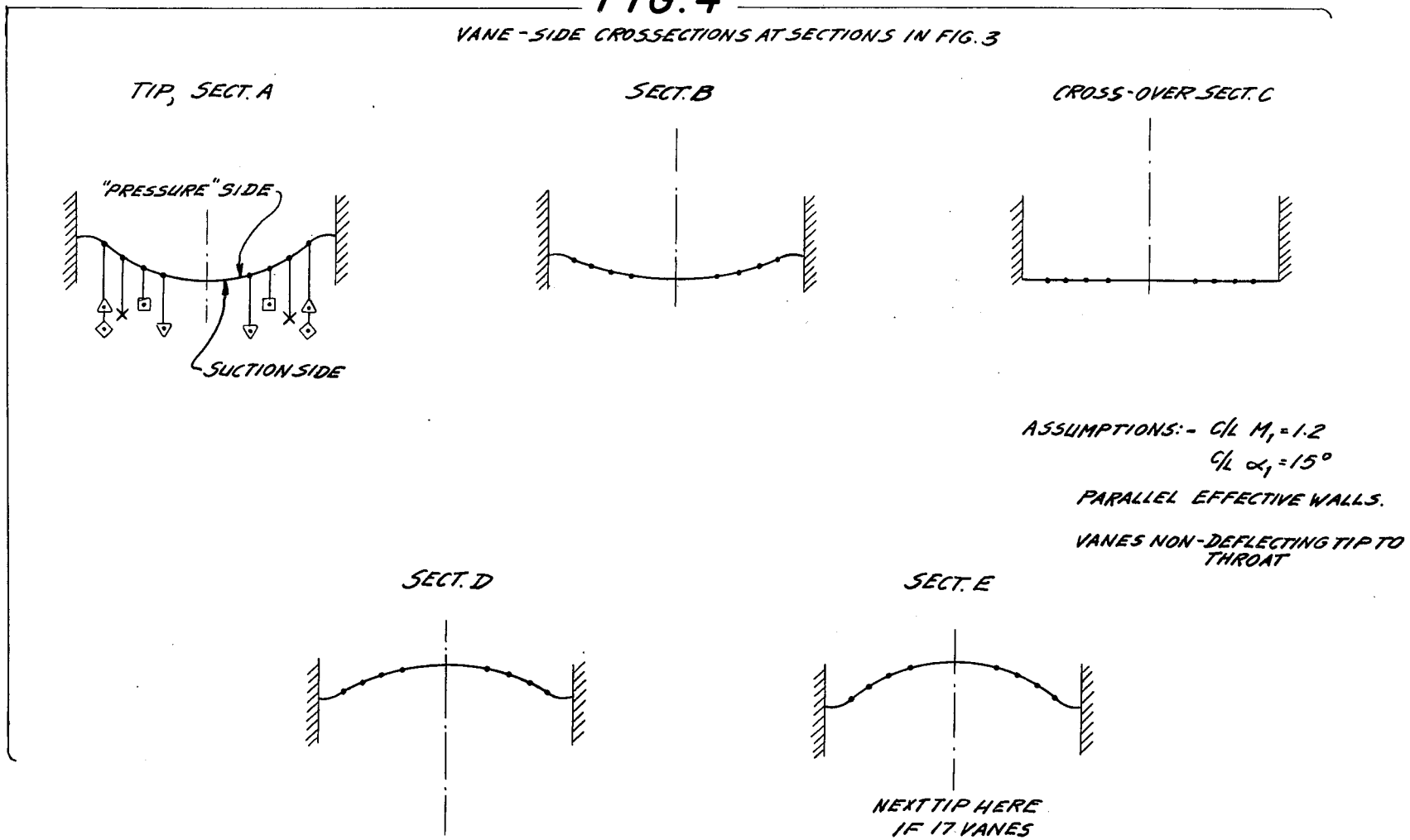
FIG. 4, shows as viewed in the direction of gas flow along the passage or vane, the proper axial vane-side cross section corresponding to the computed station of axial view FIG. 3. This

FIG. 4 arrives at the invented feature of the structure claimed, but to be discussed after discussion of its derivative FIGS. 1, 2, and 3.

Not duplicated herein from the referenced patent is the mathematics of E. S. Taylor discussed above. Exception: 4 items of its nomenclature are used herein, re-defined where used.

The designer must have data in order to assume, the shape of the relative velocity traverse across the impeller exit in the axial and radial planes. In practice, there are infinite traverse shapes existent, and thus I have assumed one such extremely highly-arched traverse.

FIG. 1, left, shows that assumed traverse. Indeed not always the case, I have assigned the max relative velocity out to the C/L location, ⊙. And I have chosen a traverse such that, at a distance from the C/L 4/5 of the way to side-wall, △, the velocity out is 0.5 of the max velocity out.

I have also selected 3 intermediate points ✕, ⊡, and ▽, lying on the traverse between ⊙, and the extreme side point △. Though I have computed the streamlines corresponding to those points, they are omitted on drawings herein, but the needed results are indeed used in FIG. 4 more accurately to plot the shape of vane-side crossection curvatures claimed.

FIG. 1, right, is a velocity diagram combining with tip speed each of the 2 ⊙ and △ relative velocities out of impeller, to arrive at the already-defined vane-approach $\alpha_1$ and $M_1$ absolute angles and velocities for each. Zero slip is assumed here, untrue unless forward-leaning impeller blades used, so as to exaggerate the difference in $M_1$'s between the ⊙ C/L path and the △ side path. (Correction, for the ⊙ C/L path, the $\alpha_1$ and the $M_1$ are not results, they are dictated. See end of specification why 15° was chosen as $\alpha_1$ for the C/L path.)

The resulting $\alpha_1$ and $M_1$ for the △ side path are not on the metal tip for that streamline, they too are on the tip circle for the C/L path. (In this example, the smallest diameter great tip circle, max traverse velocity being on the C/L.)

FIG. 1 yields the following results:

At vane tip for C/L path $\alpha_1 = 15°$ $M_1 = 1.2$ (given)

Side path △, but also at

C/L tip circle (result) $\alpha_1 = 7.63+°$ $M_1 = 1.17$—

FIG. 2 draws to scale (scale: was 4 X a 10-inch diameter C/L tip circle, but herein reduced scale to comply with patent drawing size rules) computed for effectively parallel walls and inviscid steady state flow, both the C/L ⊙ and the "4/5"-side △ streamlines in a vaneless diffuser. Station M's, and a few station $\alpha$ angles are shown on the drawing.

FIG. 3

Now by also tracing the △ side path and the C/L tip circle only, on a separate transparent vellum, and using it as a template superimposed upon the drawn FIG. 2 C/L path ⊙, and since both paths start on the same tip circle, we may rotate the template to the left about the common impeller-diffuser axis, for the side-path to enter the diffuser at any other earlier central polar angle Θ, than the central polar angle Θ for the ⊙ C/L vane tip. Exactly the same spiral, just Θ-wise an earlier-entering streamline into the diffuser, than the △ one.

FIG. 3 shows as ◇, that selected new location of the △ streamline spiral. p Now also, for this example, so as not to confuse it with any tip-notch etc. invention, I have chosen that all of the metal tip shall begin at one value of central polar angle Θ, namely that of the C/L tip, i.e. a straight line metal tip as viewed in a radial direction. This is not a "must" aerodynamically, though it does provide the strongest tip structurally, when a vane is very thin there. Discussed later below, this invention applies also to tips notched or oppositely contoured in a radial view.

FIG. 3, looking now at the metal tip, all of it beginning at the same Θ, shows this tip to be curved in a radial plane, and that the suction side of the vane for a distance thereafter is convex inwardly, (radially speaking). And here only, the pressure side of the vane is concave outwardly.

Now, because no matter at what Θ we choose by location of the rotated template of the △ side path to the left, — choose for where those ⊙ C/L and now ◇ side paths shall intersect, (section C), the 2 paths must cross as viewed axially, because they have widely different respective station α angles throughout each spiral.

Thereafter therefore, the convex suction crossection side becomes concave radially, and equally important, the concave pressure side becomes convex, after the crossover.

Influencing how much we choose to rotate the template to the left for a design, (aerodynamically, all amounts of rotation, within limits, are correct), the less we rotate it, giving a less curved metal tip crossection, radially, the greater the crossection opposite curvature (from say concave to convex), near the throat. Therefore it seems wise to balance these crossection curvatures for the tip and near-throat to be more nearly equal, by choice of how much or little to rotate the template, and this I have done in FIG. 3, equalizing these curvatures for the case of a 17-vane diffuser only.

FIG. 4

This constitutes the invention, which shows for some of the vane-side crossections axially, curvatures in radial plane resulting from my many dictates of choice for this example. Here plotted for greater accuracy of curvature, are the mentioned-above curve points corresponding to the previously mentioned FIG. 1 traverse intermediate points ✕, ⊡, and ▽, whose streamlines were computed and drawn, but not drawn herein. (Scale, before reduction for patent size: 4×a ¾" diffuser width, parallel walls.)

These curved-radially axial crossections of a vane-side, namely in direction of main gas travel convex to concave suction side, and concave to convex pressure side, confirm what I have already described qualitatively, above. The edge portions of the vane close to the side-walls in the invalid boundary layer region, are sketched in only as "art", not computed, because this inventor does not know how to compute in that region.

For section C shown in FIG. 4, (the crossover section C of FIG. 3), by choosing rotations of the template so that all streamlines cross as viewed axially at the same central polar angle Θ, the vane-side crossection there only, is designed to be flat, as shown.

Now, I stress further that (and long invented by another contributor, or more), as viewed in a radial direction, the vane tip may be notched or more-or-less pointed, i.e. not a straight line. In those cases, my metal vane axial crossections across such a tip region will have gaps in them where no metal vane exists. But the herein invention still applies to crossections of the metal vane where the metal does exist there, and thus still applies to existence of a tip-notch or to any other tip shape as viewed from a radial direction.

SOME USEFUL COMPARISONS AND LIMITATIONS

The study for this invention compared several ways with the herein example, streamlines and vane-side crossections for an $\alpha_1$ max of 22.5° vs the herein 15°, same $M_1$'s max (either 1.2 or 0.9); and for the same $\alpha_1$'s max (either 22.5° or 15°) but between the 2 different $M_1$'s max.

For the same one of either $\alpha_1$'s max, but comparing between the 2 different $M_1$'s max, we get identical spiral path shapes, despite that their respectively located stations are of widely different Mach No's. This is true not only for the 2 ⊙ C/L paths, but also for the 2 ◇ side paths.

Naturally, not so comparing at the same one of either $M_1$'s but between the 2 different $\alpha_1$'s max. Then the 22.5° $\alpha_1$ max gives greatly increased tip and early vane-side curvature over that for the 15° $\alpha_1$ max, and worse, near the throat after reversing pressure side curvature at the crossover from concave to convex, the increase in curvature can be so great as to amount roughly to a convex semicircle. Indeed this is not to be mistaken for similarity to circular passage crossection diffusers. Because herein, on the pressure side near the throat, my words "roughly a semicircle" mean convex, not concave. That is, herein the early suction side is convex, and the later-on pressure side is convex, very contrary to the structure of a circular passage crossection diffuser.

Disappointing, this invalidates a statement in referenced issued patent, which writes, in effect: "No good reason any more, why say a 22.5° $\alpha_1$ max should be any worse than the long-established by experiment 'about optimum' 15°". Here is such a good reason why perhaps the old "about optimum 15°" $_1$ max may still be valid. This is unfortunate: 15° instead of 22.5° $\alpha_1$ max implies a wider impeller tip, for more diffusion in the impeller, so combined impeller-diffuser design is still a compromise, for achieving best possible performance of the compressor as a whole.

I claim:

1. A vaned diffuser for centrifugal compressors comprising multiple vanes, each vane having an upstream tip and the axial cross section of said tip being a straight line when viewed from a radial direction, and wherein also said tip lies on a curve in a radial plane which is convex radially inwardly and concave radially outwardly, except that said radial vurvature need not apply in the wall boundary layer region close to the side-walls.

2. A vaned diffuser for centrigugal compressors comprising multiple vanes, each vane having an upstream tip which when viewed from a radial direction is notched or partly pointed or pointed, and wherein also the more than one axial cross sections of such a tip lie on curves in radial planes which are convex radially inwardly and concave radially outwardly, except that this radial curvature need not apply in the wall boundary layer region close to the side-walls.

3. A vaned diffuser for centrifugal compressors comprising multiple vanes, each having a radially inner side and a radially outer side, and wherein the axial cross section of each vane is characterized by a convex shape of the radial inner side and concave shape of the radially outer side in the upstream region following the vane tip flow-wise, except that this radial curvature need not apply in the wall boundary layer region close to the side-walls.

4. A vaned diffuser for centrifugal compressors comprising multiple vanes, each vane having a radially inner side and a radially outer side, and wherein the axial cross section of each vane is characterized by a convex shape of the radially inner side and a concave shape of the radially outer side in the upstream region following the vane tip flow-wise, except that this curvature need not apply in the wall boundary layer region close to the side-walls, and wherein also, the radial curvature of the inner and outer side cross sections becomes gradually reduced along the length of the vane in the downstream direction.

5. A vaned diffuser for a centrifugal compressor comprising multiple vanes each vane having a radially inner side and a radially outer side, and wherein the axial cross section of each vane is characterized by a convex shape of the radially inner side and a concave shape of the radially outer side in an upstream, vane tip region, the curvature of the inner and outer sides becoming gradually reduced along the length of the vane in the downstream direction, and ultimately reversing so as to produce a concave shape of the radially inner side and a convex shape of the radially outer side.

* * * * *